United States Patent [19]

Gaudet

[11] Patent Number: 4,674,724

[45] Date of Patent: Jun. 23, 1987

[54] COLLAPSIBLE STAND ESPECIALLY FOR BOOKS

[75] Inventor: Ronald F. Gaudet, Vancouver, Canada

[73] Assignee: Future Apparatus Corporation, Richmond, Canada

[21] Appl. No.: 915,968

[22] Filed: Oct. 6, 1986

Related U.S. Application Data

[63] Continuation of Ser. No. 404,885, Aug. 3, 1982, abandoned.

[51] Int. Cl.[4] ..... A47B 97/08

[52] U.S. Cl. ..... 248/459

[58] Field of Search ..... 248/447, 451–457, 248/459, 460, 462–465; 206/45.18, 45.24, 45.26; 40/124.1, 124.4

[56] References Cited

U.S. PATENT DOCUMENTS

| | | | |
|---|---|---|---|
| 1,046,100 | 12/1912 | Miller | 248/452 |
| 1,897,305 | 2/1933 | Doherty . | |
| 1,953,673 | 4/1934 | Davidson | 40/124.1 |
| 2,165,255 | 7/1939 | Hamilton . | |
| 2,270,763 | 1/1942 | Nofziger | 40/124.1 |
| 2,784,929 | 3/1957 | Diening . | |
| 3,411,741 | 11/1968 | Nadler | 248/459 |
| 3,447,770 | 6/1969 | Gallamos | 248/459 |
| 3,460,795 | 8/1969 | Dahlin | 248/465 |
| 3,937,435 | 2/1976 | Roberts | 248/465 |
| 4,016,919 | 4/1977 | Zmijewski | 248/459 |
| 4,044,980 | 8/1977 | Cummins | 248/459 |

FOREIGN PATENT DOCUMENTS

| | | | |
|---|---|---|---|
| 466748 | 7/1950 | Canada | 248/459 |
| 2702587 | 5/1978 | Fed. Rep. of Germany . | |
| 121227 | 2/1982 | Japan . | |

*Primary Examiner*—J. Franklin Foss
*Assistant Examiner*—Robert A. Olson
*Attorney, Agent, or Firm*—Shlesinger Arkwright Garvey & Fado

[57] ABSTRACT

A one-piece collapsible stand, especially for a book, made of suitable material, like corrugated cardboard or polypropylene, by stamping or molding. In its collapsed configuration, all components of the stand are coplanar. The stand comprises a frame-like bottom plate, to which a center leg and two side legs are connected by integral hinges. Complementary latch notches in the side of engaging legs adjacent their free ends interlock to fix the structure in its erected, operative configuration.

15 Claims, 3 Drawing Figures

COLLAPSIBLE STAND ESPECIALLY FOR BOOKS

This application is a continuation of application Ser. No. 404,885, filed Aug. 3, 1982, now abandoned.

BACKGROUND OF THE INVENTION

1. Field of the Invention

The invention relates to a collapsible stand, especially for books or other material, which are to be held in a convenient position for reading. Although below the device according to the invention is referred to as a book stand, it should be clearly understood that the stand can also be used for other purposes, e.g. for the storage or display of record albums or other substantially flat articles.

2. Prior Art

U.S. Pat. No. 3,460,795 to Dahlin discloses a book holder comprising a frame-like bottom plate. A divided support plate is rotatably connected to one side of the bottom plate, and a brace is rotatably connected to its opposite side. The upper end of the support plate is furnished with two cavities into which two pegs on the brace can be fitted to keep the support plate in its upright angled position for supporting a book. In the folded down position of the book holder, the support plate and the brace are coplanar with the bottom plate. The support plate and the brace are connected to the bottom plate by hinge pins. This holder must be made of fairly solid material to withstand the stresses to repeated use with the weight of heavy books tending to bend the outer sections of the arms of the support plate backwards.

U.S. Pat. No. 3,937,435 to Roberts relates to a collapsible book support having tabs pivotally connected to the base. These tabs are holding the pages of a book on the book support in place when pivoted upwards. When the tabs are pivoted downwards into their respective cavities, they are coplanar with the base.

From U.S. Pat No. 3,411,741 to Nadler it is known to form a book rest in one piece in its flat configuration of a suitable plastic material, like polypropylene, utilizing a stamping or molding operation. The well known physical characteristic of polypropylene is used of forming integral hinges along lines of reduced thickness, which can be bent many times without fatigue failure. In its erected operative configuration various structural members are engaged by interlocking latch notches.

SUMMARY OF THE INVENTION

It is an object of the invention to provide a one-piece collapsible book stand made of lightweight material by stamping or molding, and to arrange the structural members in such a way, that also heavy books can be safely supported by a simple structure, that is easy and inexpensive to manufacture.

The invention relates to a one-piece collapsible stand, especially for a book, made of suitable material by stamping or molding, the stand being foldable between an erected, operative configuration and a collapsed, inoperative configuration wherein all of its components are coplanar. The stand comprises a frame-like bottom plate having a front edge portion and a rear edge portion; a center leg having two sides and a free end and being connected to the front edge portion by an integral hinge; one side leg on each side of the center leg, each side leg having an inner side, and outer side, and a free end, and being connected to the rear edge portion by an integral hinge; latch notches on each side of the center leg adjacent the free end; complementary latch notches on the inner side adjacent the free end of each side leg; and table means for preventing the article to be supported from sliding off the stand, the tab means being connected to the front edge portion by an integral hinge. All intergral hinges have their pivotal axis formed by a line of reduced thickness of the material. The engaging sides of the legs are formed such that the latch notches interlock for fixing the legs in the erected, operative configuration.

DETAILED DISCLOSURE

Figure 1:
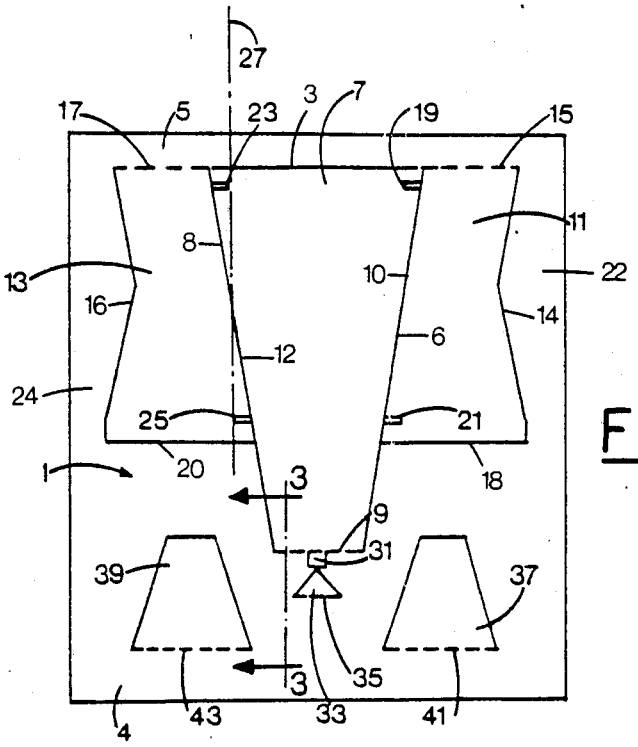
FIG. 1 is a top plan view of a book stand according to the invention, the stand being shown in its collapsed, inoperative configuration.
Figure 2:
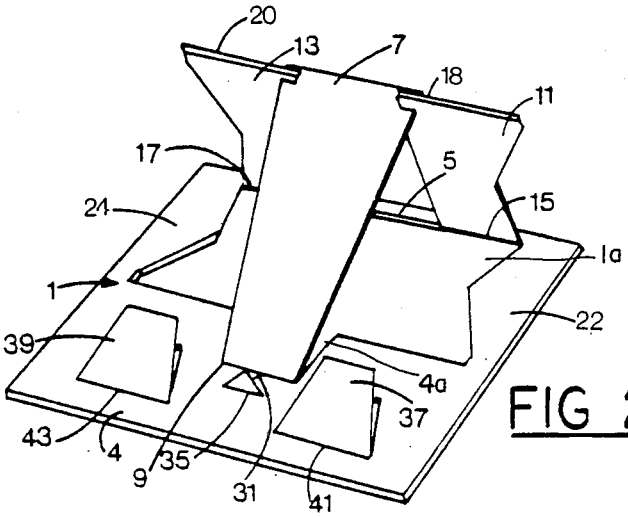
FIG. 2 is a perspective view of the book stand of FIG. 1 shown in its erected, operative configuration.

The stand shown in FIGS. 1 and 2 is made of a material that can be stamped or molded and that has the property of being bendable for a considerable number of times along lines of reduced thickness without showing fatigue failure. Corrugated cardboard or polypropylene are examples of such materials that lend themselves to forming integral hinges as further described below.

Figure 3:
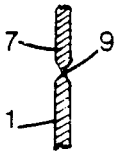
FIG. 3 shows an integral hinge in fragmented cross section along the lines 3—3 in FIG. 1.

In its collapsed configuration, the stand resembles a flat sheet of material with cut lines as shown. The stand comprises a bottom plate 1 having a front edge portion 4, a rear edge portion 5 and two side edge portions 22 and 24 extending between the front and rear edge portions to form a closed, generally rectangular base. A generally oblong opening 1*a* is formed in bottom plate 1. The front edge portion 4 includes a central recess 4*a* communicating with the generally oblong opening 1*a*. The central recess 4*a* extends a substantial distance into the front edge portion 4. A center leg 7 has two sides 6 and 8 and free end 3. Central leg 7 is hingedly connected to a front edge of central recess 4*a* forming a central hinge 9. The hinge 9 is an area of reduced thickness obtained by grooving the material on both sides to serve as an integral central hinge 9 as shown in cross section in FIG. 3 and in broken lines in FIG. 1. Two side legs 11 and 13 are similarly connected to the bottom plate 1 adjacent the rear edge portion 5 by integral side hinges 15 and 17. The hinges 15 and 17 are generally aligned with each other and are generally parallel to the hinge 9. The legs 11 and 13 have respective inner sides 10 and 12, outer sides 14 and 16, and free ends 18 and 20. The side edges 6 and 8 of the central leg 7 are inclined obliquely to the central hinge 9 at an angle other than a right angle. As shown, the edges 6 and 8 diverge from the central hinge 9 towards the free end 3 to produce an inversely tapered center leg in which the free end 3 is wider than length of the central hinge 9. Similarly, the inner sides 10 and 12 of the side legs converge towards each other from their respective side hinges 15 and 17 to be generally adjacent the side edges 6 and 8 of the center leg. In their erected, operative configuration the legs can be interlocked by parallel latch notches 19, 21 and 23, 25 respectively. The closed ends of engaging latch notches are positioned in a common datum line 27, which is essentially at right angles to the pivotal axis of the corresponding hinge. This is shown in FIG. 1, where 23 and 25 are the engaging latch notches of the center leg 7 and the side leg 13; the common line 27 is at right angles to the pivotal axis of the hinge 17. Thus a stable, easel-like support is created.

A recess in the form of a cut-out square 31 is provided in the front edge portion 4 adjacent the center leg 7. This recess is provided for receiving the solid end of the spine of the magazine, so that the magazine is prevented from sliding off the stand when supported by it. The recess can also be formed as an elongated indentation (not shown) without being cut-out, for receiving the solid end of the spine of a thick paperback. A triangular tab 33 is provided on the front edge portion 4 adjacent the center leg 7. This first tab means can be bent upwards about an integral first tab hinge 35 and fits into the space between the spine and the block of bound-together pages of a book and keeps the book from sliding off the stand.

Second tab means 37 and 39 are provided on the front edge portion 4 on either side of the center leg 7. These tabs can be bent upwards about integral second tab hinges 41 and 43 and serve for holding the pages of a book or magazine. They can also prevent a stack of record albums from sliding off the stand.

With the stand according to the invention erected, the free ends 18 and 20 of the side legs project forwardly of the center leg 7 and are adapted to contact and support covers of a book supported on the stand. Thus the force of the weight of a heavy book acts mostly on the free ends 18 and 20 of the side legs 11 and 13 in the direction of the longitudinal axis of each leg. This is the direction of the greatest strength of the legs and, therefore, heavy loads can be supported on a relatively light and inexpensive structure. Also, there is very little stress on the latch notches 19, 21, 23 and 25 of the stand according to the invention, which increases its useful life.

I claim:

1. A one-piece collaspsible stand which is foldable between an erected, operative configuration for supporting a book or the like in an inclined position, and a collapsed in-operative configuration wherein the stand is flat, the stand including:

(a) a frame-like bottom plate having a front edge portion, a rear edge portion, and two side edge portions extending between the front and rear edge portions to form a closed, generally rectangular base, (b) said bottom plate when said stand is erected having a generally oblong opening including front, rear and side edges, (c) said front edge of said generally oblong opening when said stand is erected having a central recess extending a substantial distance into said front edge portion, (d) said central recess having side edges and a front edge, (e) a center leg having two sides and a free end and being connected to said front edge of said central recess by an integral central hinge, said center leg being adapted to fit within the bottom plate when folded flat, each side of the center leg having a central latch notch adjacent the free end of said center leg, each latch notch having a respective closed end positioned on a respective datum line disposed essentially at right angles to said central hinge, (f) two side legs disposed on opposite sides of said center leg, each side leg having an inner side, an outer side, and a free end, and being connected to said rear edge portion by an integral side hinge spaced from said central hinge, said inner side of each side leg leg being generally adjacent to an adjacent side to said center leg when the three legs are folded flat to fit within said bottom plate, each inner side having a side latch notch adjacent said free end of said side leg, each side latch notch having a closed end positioned adjacent the respective datum line, (g) said center leg being substantially greater in length than said side legs, (h) said center leg being hingedly connected to said front edge of said central recess whereby when said legs are erected the obtuse angle formed by said center leg and said bottom plate is greater than the obtuse angle formed by said side legs and said bottom plate, (i) said side latch notches of said side legs being parallel to said central latch notches in the flat and erected positions, (j) said side latch notches and said central latch notches being parallel to said central hinge and side hinges in the flat and erected positions, (k) said side latch notches and said central latch notches being so arranged to permit engaging of said notches for holding said legs in the erected operative configuration extending above said bottom plate, (l) said central hinge and side hinges having pivotal axes formed by lines of reduced thickness, (m) said free ends of said side legs each having a supporting edge, (n) said supporting edges of said side legs being spaced a substantial distance from said notches on said side legs, (o) said center leg having a non-supporting edge parallel to said side legs supporting edges and extending beyond said central latch notches a distance approximately equal to the distance said supporting edges of said side legs extend beyond said side latch notches whereby when said legs are erected and notched together said center leg nonsupporting edge avoids interference with a book when positioned on said stand, (p) said side legs supporting edges having a combined length extending laterally a distance greater than the length of said center leg non-supporting edge, (q) tab means for preventing the book or the like to be supported from sliding off the stand, said tab means being connected to said front edge portion by an integral tab hinge, (r) said front edge portion of said bottom plate being substantially wider than said rear portion, and (s) said tab means being adapted to fit within the bottom plate when folded flat.

2. A stand as in claim 1, wherein:

(a) said supporting edges project forwardly from the center leg for directly supporting covers of a book supported on the stand, (b) said supporting edges each having a surface area substantially less than the surface area of the top face of said center leg, and (c) said side legs are adapted to support books on the stand such that the force of the weight acts in a direction of a longitudinal axis of each leg.

3. A stand as in claim 1, wherein:
(a) said front edge portion includes a first opening extending through said frame-like bottom plate for receiving a first tab means, and
(b) said first opening includes front, rear, left and right side edges.

4. A stand as in claim 3, wherein:
(a) said front edge portion includes a second opening extending through said frame-like bottom plate for receiving a second tab means, and
(b) said second opening includes front, rear, left and right side edges.

5. A stand as in claim 3, wherein:
(a) said front edge of said first opening is substantially greater in length than said rear edge of said first opening,
(b) said left edge of said first opening forming an acute angle with said front edge of said first opening,
(c) said right edge of said first opening forming an acute angle with said front edge of said first opening, and
(d) said first tab means being hingedly connected to said front edge of said first opening.

6. A stand as in claim 4, wherein:
(a) said front edge of said second opening is substantially greater in length than said rear edge of said second opening,
(b) said left edge of said second opening forming an acute angle with said front edge of said second opening,
(c) said right edge of said second opening forming an acute angle with said front edge of said second opening, and
(d) said second tab means being hingedly connected to said front edge of said second opening.

7. A stand as in claim 4, wherein:
(a) said first and second openings are formed equidistant and inwardly from the outermost portion of said front edge portion of said frame-like bottom plate.

8. A stand as in claim 1, wherein:
(a) said outer side of said side legs include first and second sections,
(b) said second section is adjacent said free end of said side legs,
(c) said second section is substantially greater in length than said first section, and
(d) said first section forming an obtuse angle with said second section less than 180°.

9. A stand as claimed in claim 1, in which, when the stand is collapsed:
(a) the side edges of the center leg diverge from the central hinge towards the free end of the center leg to produce an inversely tapered center leg in which the free end is wider than the length of the central hinge,
(b) the inner sides of the side legs similarly converge towards each other from their respective side hinges to be generally adjacent the side edges of the center leg.

10. A stand as claimed in claim 1, in which:
(a) the side hinges of the side legs are aligned with each other and are disposed parallel to the central hinge of the outer leg.

11. A stand as claimed in claim 1, further including:
(a) first tab means provided on the front edge portion adjacent the center leg, the first tab means being hinged to the front edge portion by an integral first tab hinge.

12. A stand as claimed in claim 11 in which the first tab hinge is disposed parallel to and spaced closely from the central hinge of the center leg.

13. A stand as claimed in claim 1, further including:
(a) second tab means provided on the front edge portion on either side of the center leg, each second tab means being hinged to the front edge portion by an integral second tab hinge.

14. A stand as claimed in claim 13, in which:
(a) the second tab hinges are generally aligned with each other.

15. A stand as claimed in claim 1 wherein the front edge portion includes an aperture positioned adjacent the center leg to provide an edge to engage the book or the like supported on the center leg.

* * * * *